United States Patent [19]

Henry

[11] 4,158,937

[45] Jun. 26, 1979

[54] CONCRETE SCREED ADJUSTABLE STIRRUP

[76] Inventor: Wendell L. Henry, 1702 Norwood, Brainerd, Minn. 56401

[21] Appl. No.: 841,805

[22] Filed: Jan. 12, 1978

[51] Int. Cl.[2] ..... E04C 3/16

[52] U.S. Cl. ..... 52/365; 52/367; 52/707

[58] Field of Search ..... 52/365, 367, 707, 708, 52/704, 126, 371, 372

[56] References Cited

U.S. PATENT DOCUMENTS

| | | | |
|---|---|---|---|
| 2,140,919 | 12/1938 | Mushet | 52/707 X |
| 2,227,713 | 1/1941 | Higgins | 52/365 |
| 2,867,041 | 1/1959 | McMillan | 52/704 X |
| 3,006,115 | 10/1961 | Hillberg | 52/365 |
| 3,830,024 | 8/1974 | Wamke | 52/126 X |

*Primary Examiner*—Price C. Faw, Jr.
*Assistant Examiner*—Carl D. Friedman
*Attorney, Agent, or Firm*—Merchant, Gould, Smith, Edell, Welter & Schmidt

[57] ABSTRACT

A stirrup for supporting elongated guide bars or rods for concrete screeds or strike bars used in leveling poured concrete floors, pavement and the like. The stirrup is vertically adjustably supported by a stud screw threaded in a base portion and extending upwardly from the base portion, the base portion being disposed to be embedded in a base slab.

1 Claim, 4 Drawing Figures

FIG. 1
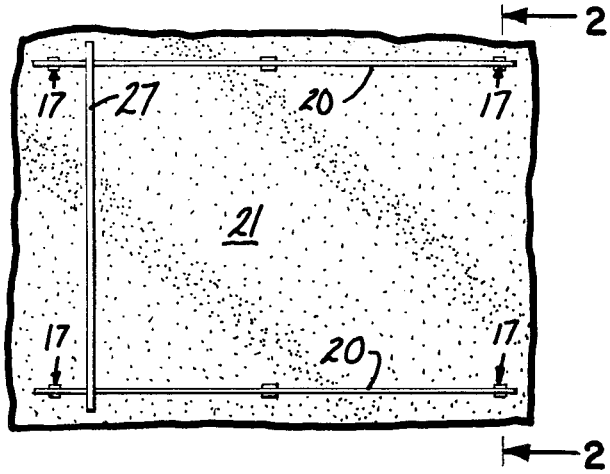
FIG. 3
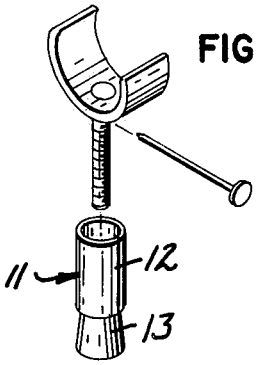
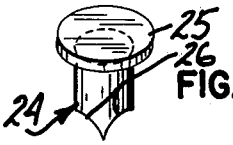
FIG. 4
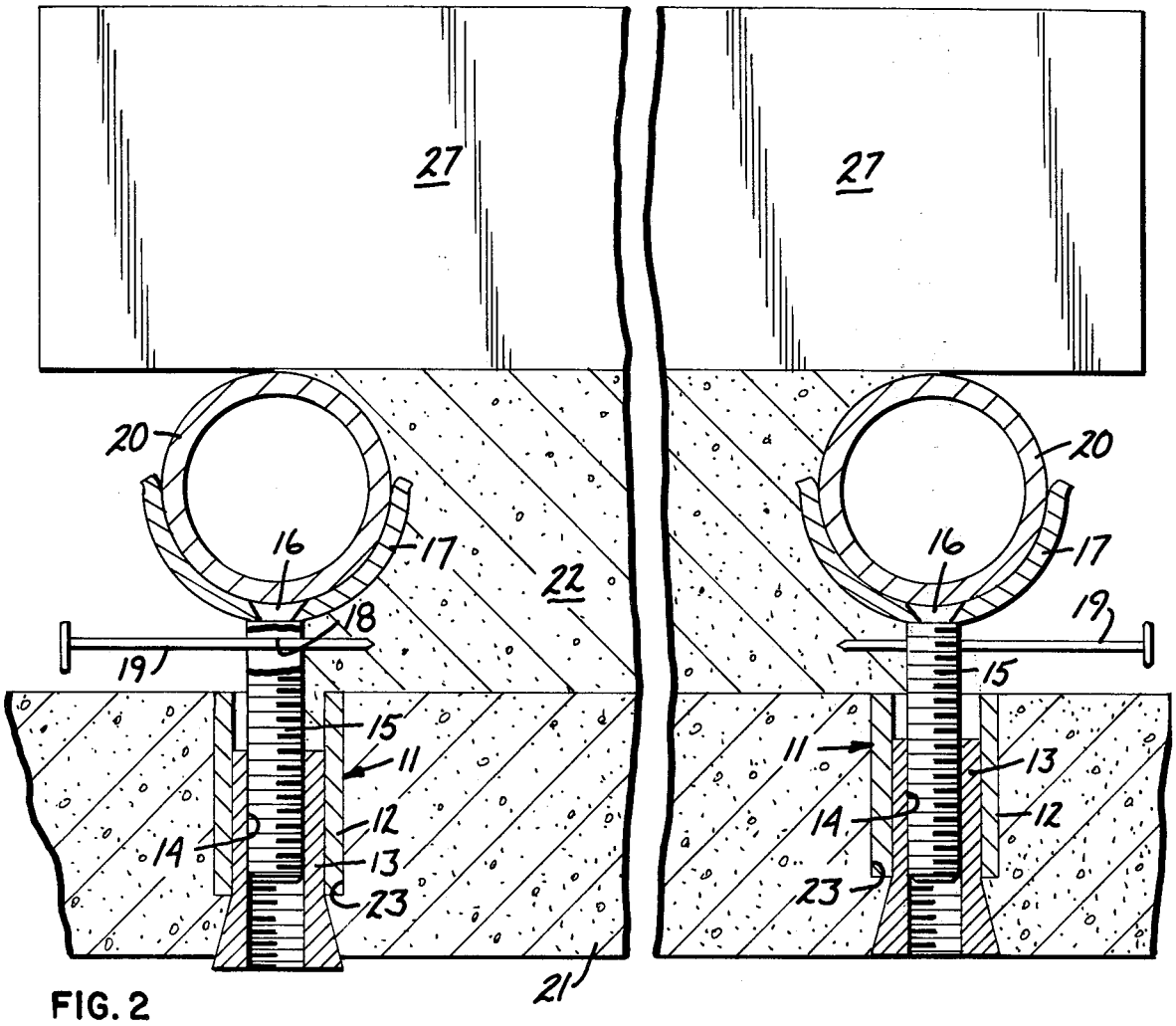
FIG. 2

CONCRETE SCREED ADJUSTABLE STIRRUP

BACKGROUND OF THE INVENTION

In laying concrete floors, ramps, pavement and like horizontal structures, it is customary in some instances to first provide a foundation or base slab, after which a top or finish layer is applied to the slab. Elongated boards or rods are mounted on the base slab to provide guide surfaces for the usual strike board or screed used in leveling or flattening the top surface of the finish layer. In order that the top surface be uniform over a fairly large area, it is important that the top surfaces of the guide boards or rods be disposed at a predetermined level from end to end thereof and relative to each other. This has heretofore been a problem, particularly when the top surface of a base slab is rough and uneven, requiring wedging of the guide boards or rods to bring the same, or at least portions thereof, to the required level.

SUMMARY OF THE INVENTION

The supporting stirrup of this invention enables a screed supporting guide member to be quickly and easily adjusted to a required level from end to end thereof and relative to the level of another guide member, as well as to be securely supported at the desired level. The supporting stirrup of this invention involves a base portion disposed to be embedded in a base slab, the base portion having a vertically extended threaded opening therein, a stud member screw threadedly received in the opening and extending upwardly from said base portion. A generally U-shaped stirrup element is mounted on the upper end of said stud for rotation on the axis of said stud, and means is provided for rotating the stud relative to said base portion, whereby to vertically move said stirrup element relative to said base portion.

BRIEF DESCRIPTION OF THE DRAWING

FIG. 1 is a fragmentary view in top plan of a base or foundation slab of poured concrete, showing a pair of screed supporting members mounted on a plurality of the adjustable supports of this invention;

FIG. 2 is an enlarged fragmentary section taken on the line 2—2 of FIG. 1, and showing the top layer or slab of concrete disposed between the guide rods on the adjustable supports;

FIG. 3 is an exploded perspective view of the adjustable support of this invention; and FIG. 4 is a view in perspective of a plug used to aid in mounting the adjustable support.

DETAILED DESCRIPTION OF THE PREFERRED EMBODIMENT

The adjustable support of this invention includes a base portion 11 that is commonly known as an expansion shield and which comprises an outer radially expansible sleeve 12 and an inner expander member 13 having a screw threaded axial opening 14 therethrough. An elongated stud 15 is screw threadedly received in the opening 14, and has a neck portion 16 at its upper end on which is journaled a generally U-shaped stirrup element 17. Just below the neck portion 16, the stud 15 is provided with a transverse opening 18 for reception of a pin or nail 19 by means of which the stud 15 may be rotated with respect to the expander 13. As shown, the stirrup 17 is adapted to receive and support the lower portion of an elongated screed guide 20 which may be of any suitable form but which, for the purpose of the present example, is shown as being in the nature of an elongated tube.

The above-described adjustable support is particularly adapted for use in the covering of a base slab of concrete or other suitable material with a top or finish slab. In the drawings, a base slab is indicated at 21, the top slab being shown in FIG. 2 and indicated at 22. When the base slab 21 is hardened or in a condition to support the top or finish slab 22, a hole is bored or otherwise produced in the base slab for each support. A pair of such holes is shown in FIG. 2 and indicated at 23. In the event that the base slab is made of poured concrete, the holes 23 may be produced with the use of plugs 24, one of which is shown in FIG. 4. These plugs may be inserted into the base slab while the same is in a fairly soft condition. As shown, each plug is formed with an enlarged diameter top flange 25 and a sharpened bottom end 26. The top flange 25 limits downward movement of the plug 24 into the base slab 21. When the base slab 21 is sufficiently hard to support the top slab 22, the plugs 24 are removed.

A base portion 11 of each adjustable support is inserted into each opening 23, and the outer sleeve 12 is expanded so that the base portion 11 is firmly held in its respective opening 23. Expansion of the sleeves 12 is achieved in the usual manner by a bolt, not shown, but screw threaded into the opening 14, and removed when the sleeve 12 is expanded sufficiently to firmly anchor the base portion 11 within its respective opening. A stirrup-equipped stud 15 is then screw threaded into each base portion 11 with the assistance of a pin or nail 19 and a screed guide rod or tube 20 is placed in two or more stirrups disposed in a row, as shown in FIG. 1. Each stirrup 17 is then adjusted to proper height by rotation of its stud 15, and the finish coat or slab 22 of concrete is poured into the area between the screed guides 20. The usual screed or striker bar, indicated at 27, is then used to produce a level top surface of the slab 22 between the screed guides 20, in the usual manner. After the top slab 22 has set sufficiently to be at least partially self-supporting, the screed guides 20 may be removed and the area filled in with cement.

The studs 15 and stirrups 17 may be made sufficiently inexpensive so as to permit the same to remain embedded in the top slab, if desired, otherwise, these may be removed from their base portions 11 and the area filled with cement.

While I have shown and described a commercial embodiment of my adjustable support for screed guides, it will be understood that the same is capable of modification without departure from the spirit and scope of the invention, as defined in the claims.

What I claim is:

1. An adjustable support for screed guides, said support comprising:

(a) a base portion disposed to be embedded in a base slab, and including an outer tubular expansion shield member and an inner expander member having a vertically extended threaded opening therein;

(b) a stud member screw threadedly received in said opening and extending upwardly from said base portion;

(c) a rigid generally U-shaped stirrup element mounted on the upper end of said stud for rotation on the axis of said stud and relative to said stud;

(d) said stud having a transverse opening therethrough, further including a pin element axially slidably received in said transverse opening for rotating said stud relative to said base portion and stirrup element, whereby to vertically move said stirrup element relative to said base portion.

* * * * *